US012326144B2

(12) United States Patent
Favilli et al.

(10) Patent No.: US 12,326,144 B2
(45) Date of Patent: Jun. 10, 2025

(54) METHOD AND A DEVICE FOR CHANGING THE COMPRESSION RATIO OF A RECIPROCATING COMPRESSOR

(71) Applicant: SIME S.R.L., Rosignano Solvay (IT)

(72) Inventors: Stefano Favilli, Rosignano Marittimo (IT); Stefano Meucci, Rosignano Solvay (IT)

(73) Assignee: SIME S.R.L., Rosignano (IT)

( * ) Notice: Subject to any disclaimer, the term of this patent is extended or adjusted under 35 U.S.C. 154(b) by 258 days.

(21) Appl. No.: 18/028,969

(22) PCT Filed: Sep. 28, 2021

(86) PCT No.: PCT/IB2021/058871
§ 371 (c)(1),
(2) Date: Mar. 28, 2023

(87) PCT Pub. No.: WO2022/064474
PCT Pub. Date: Mar. 31, 2022

(65) Prior Publication Data

US 2023/0366389 A1 Nov. 16, 2023

(30) Foreign Application Priority Data

Sep. 28, 2020 (IT) ..... 102020000022762

(51) Int. Cl.
*F04B 49/00* (2006.01)
*F04B 25/00* (2006.01)

(52) U.S. Cl.
CPC ..... *F04B 49/007* (2013.01); *F04B 25/00* (2013.01)

(58) Field of Classification Search
CPC ..... F04B 49/007; F04B 25/00
See application file for complete search history.

(56) References Cited

U.S. PATENT DOCUMENTS 1,580,973 A * 4/1926 Rembold ..... F04B 25/02 417/62
4,455,125 A 6/1984 Irwin
(Continued)

FOREIGN PATENT DOCUMENTS

CA 2 511 254 A1 10/2005
CN 108757422 A * 11/2018 ..... F04B 25/00
(Continued)

*Primary Examiner* — Nathan C Zollinger
(74) *Attorney, Agent, or Firm* — Maschoff Brennan

(57) ABSTRACT

A device and method are used for changing the compression ratio of a reciprocating compressor. The device includes compression chambers pneumatically connected between an inlet and an outlet port. Communication valves change the number of compression steps and are arranged to switch from a first to a second open/closed state combination, or vice-versa. A lower number and a higher number, and vice-versa, respectively, of the compression chambers include chambers serially connected to one another, so that a gas is subjected to a number of compression steps that increases when switching from the first to the second combination and decreases when switching in the opposite direction. A control unit receives pressure signals upstream and downstream of the reciprocating compressor, respectively, to compute the corresponding pressure ratios, to generate opening/closing control signals responsive to the pressure ratios, and to transfer the control signals to actuators of the commutation valves.

11 Claims, 8 Drawing Sheets

(56) References Cited

U.S. PATENT DOCUMENTS

| | | | | |
|---|---|---|---|---|
| 8,231,357 | B2 * | 7/2012 | Huttar | F04B 49/007 417/254 |
| 2010/0329903 | A1 | 12/2010 | Fong et al. | |
| 2012/0100062 | A1 | 4/2012 | Nakamura et al. | |
| 2016/0123314 | A1 | 5/2016 | Ignatiev et al. | |
| 2019/0032553 | A1 | 1/2019 | Sokalski | |

FOREIGN PATENT DOCUMENTS

| | | | |
|---|---|---|---|
| CN | 109973374 | A | 7/2019 |
| JP | H08-49653 | A | 2/1996 |
| KR | 10-1352805 | B1 | 1/2014 |
| WO | 2012/021928 | A1 | 2/2012 |

* cited by examiner 106
105
49
41
90
50
W6
34
PT
$44_N$
$46_N$
60
47
C3
C4
C7
C5
C8
C1
C2
20
23
22
21
24
27
28
29
25
26
W3
W12
W5
W4
W2
$45_1$
10
13
12
11
14
17
18
19
15
16
W1
$42_1$
W7
40
80

METHOD AND A DEVICE FOR CHANGING THE COMPRESSION RATIO OF A RECIPROCATING COMPRESSOR

SCOPE OF THE INVENTION

The present invention relates to a method and to a device for changing the compression ratio of a reciprocating compressor and, in particular, it also relates to a compression unit comprising said reciprocating compressor and equipped with said device.

The invention also relates to a process and to an apparatus for evacuating a valuable and/or harmful gas from a closed space, and for transferring the gas into a delivery environment at a predetermined pressure.

PRIOR ART-TECHNICAL PROBLEM

As well known, reciprocating compressors, in particular piston compressors, are normally used when relatively small gas streams must be compressed, and high compression ratios are required. In order to obtain a predetermined compression ratio, compression units including a plurality of serially connected cylinder-piston units are often used. It is rather easy to regulate the flowrate of a reciprocating compressor, by somehow modifying the number of intake-compression cycles per time unit, or by adjusting the stroke length of the piston. On the contrary, the compression ratio of such an equipment is much harder to change. Several reciprocating compressors have been proposed allowing to change the compression ratio, see for instance KR101352805 B1, JPH0849653 A, CN109973374 A and US2019032553 A1. However, these solutions are difficult to manufacture, involve high manufacture/maintenance costs, and do not always allow a real-time compression ratio change, as required in some processes.

For example, the need to change the compression ratio of a reciprocating compressor arises if the compressor is used, in a substantially continuous service, to transfer a gas from a suction environment to a delivery environment, when the suction pressure and/or the delivery pressure remarkably change during the transfer, which requires adapting the compression ratio provided by the compressor.

A variable compression ratio is also required when the reciprocating compressor is used to evacuate a valuable and/or harmful gas from a closed space and to transfer the gas into a delivery environment at a predetermined delivery pressure, for example at a substantially constant delivery pressure, i.e. at a delivery pressure that remains substantially unchanged during the evacuation/transfer operation.

In particular, this is the case when a plant section, such as a compression section of a gas pipeline, must be evacuated, for example, if a stop condition of the gas pipeline main compressor has occurred, or if the main compressor must be stopped for maintenance, or due to a gas request decrease from the network.

In such conditions, a gas substantially consisting of methane must be removed from the involved plant section. The evacuated gas is normally released into the environment as such or is burnt in a chimney. In both cases, a greenhouse effect gas is emitted into the environment. This is particularly serious in the first case, since methane is much more harmful than carbon dioxide as a greenhouse effect gas. In the latter case, instead, the emissions can also contain nitrogen oxides. In both cases a financial loss is involved, which depends not only on the intrinsic value of the gas that is directly emitted or burnt, but on the higher and higher taxes imposed in an increasing number of states to the users of plants even occasionally releasing greenhouse effect gases.

It is worthwhile to note that the temporary stop of a compression facility can occur even daily, in particular, due to commercial dynamics.

The need is therefore felt to prevent harmful and/or valuable gas to be emitted into the environment from normally pressurized plant sections when these plant sections are temporary or definitely put out of service.

In the exemplary case of a gas pipeline compression facility, the solution to such a problem could consist in introducing the evacuated gas into the gas pipeline itself again. However, in order to put such a solution into practice, the gas must be conveyed from a closed space at a pressure $P_{sc}$ that decreases as the gas is evacuated, into a reception space, in this case the gas pipeline, that is at a predetermined working pressure $P_e$. At the beginning of the evacuation, the pressure in the closed space $P_{SC}$ is close to the working pressure $P_e$ of the gas pipeline, and the compression unit used for this service is required to provide a compression ratio $P_e/P_{sc}$ of about 1. As the evacuation proceeds, pressure $P_{SC}$ in closed space decreases, while the working pressure $P_e$ remains substantially unchanged, so the compression unit is required to provide an increasing compression ratio $P_e/P_{sc}$. The lower the residual pressure tolerated in the closed space or in the plant section to be evacuated, the higher is the final compression ratio. This admissible residual pressure is normally about a few tenths of bar above the atmospheric pressure, so as to minimize the net residual emissions.

During the evacuation, the flowrate demand to the compression unit can remarkably decrease. The compression unit is advantageously sized to allow flowrate evacuation values high enough to complete the evacuation in an acceptable time.

Preferably, the above-described service can be carried out by a reciprocating compression unit, in particular by a piston compression unit. In fact, in comparison with the rotating compressors, this type of equipment is better suited for a discontinuous service and reaches more easily the steady operating conditions. Moreover, the required flowrates normally fall within the flowrate field in which the reciprocating compressors are preferable to the rotating compressors.

Briefly, there is the need for a method and a device for changing the compression ratio of a reciprocating compression unit, in particular from values of about 1:1 up to values of about 50:1 and also up to 100:1, taking into account, for example, the common gas pipelines operating pressures. It is also relevant that such method and device allow a quick compression ratio adjustment, so as to adapt the pressure ratio to the upstream pressure change and to the downstream pressure change in particular cases of continuous gas transfer.

As an example, in order to describe the technical problems, reference has been made till now to a gas pipeline compression facility as a closed space to be evacuated. However, similar reasonings can be made for any facility in which a harmful and/or valuable pressurized gas is treated, for instance natural gas liquefaction facilities, $CO_2$ recovery and storage plants, technical gas production and storage/distribution plants, chemical and petrochemical plants, such as polyolefin production facilities, in which pressurized gaseous polyolefins are manipulated. In fact, in all these cases, the release and/or the combustion of the evacuated gas causes a financial loss or harm to the environment to such an extent depending on the gas value/harmfulness. Moreover, in all these cases a pressurized reception space can be identified, such as a storage unit, or a distribution pipe network, into which the evacuated gas can be conveyed.

US 2016/0123314 A1 describes a compressor of a refrigeration plant including multiple compression chambers that can be connected to each other in different configurations by suitably opening and closing a plurality of valves, so as to compress the refrigerant fluid in different numbers of compression steps. The passage from one configuration to another configuration is controlled by a control module responsive to the cooling power required to the refrigeration plant and, accordingly, responsive to a corresponding flow-rate of the refrigerant fluid to be compressed.

WO 2012/021928 A2 describes a compressor for compressing air in a plant for making articles such as PET bottles, configured to provide a plurality of serially arranged compression steps and to sequentially activate/deactivate the compression steps as the high-pressure air request increases/decreases.

SUMMARY OF THE INVENTION

It is therefore a feature of the present invention to provide a method and a device for changing the compression ratio of a new or existing reciprocating compressor, from a value of about one to a value of some tenths or even one hundred.

It is a particular feature of the present invention to provide a method and an apparatus for evacuating a valuable and/or harmful gas from a closed space into a delivery environment at a predetermined pressure, which allows an amount of gas left in the closed space corresponding to a pressure of at most 0,1 bar gauge, at the end of the gas compression/transfer.

It is also a feature of the invention to provide a compression unit which carries out the method, or that comprises such device associated to a reciprocating compressor.

It is a particular feature of the invention to provide such a device for changing the compression ratio, which allows a reciprocating compressor to continuously convey a gas from a suction environment at a suction pressure into a delivery environment at a delivery pressure, in which the suction pressure and/or the delivery pressure can suddenly and unpredictably change to a relevant extent.

These and other objects are achieved by a method and by a device for changing the compression ratio of a reciprocating compressor, the reciprocating compressor comprising an inlet port for a gas to be compressed and an outlet port for a compressed gas, and a plurality of piston-cylinder units defining a plurality of compression chambers that are pneumatically connected between the inlet port and the outlet port, as defined in claims 1 and 8, respectively, and by a compression unit comprising said device, as defined in claim 11. Advantageous modifications of the method and advantageous exemplary embodiments of the device are defined by respective dependent claims.

According to one aspect of the invention, a method is provided comprising the steps of:

- prearranging, on the reciprocating compressor, a plurality of commutation valves for changing the number of compression steps of the reciprocating compressor, each commutation valve configured to switch from a respective open status to a respective closed status, and vice-versa;
- receiving the gas to be compressed into the reciprocating compressor through the inlet mouth, and compressing the gas to be compressed, thus obtaining the compressed gas at the outlet port;
- causing the plurality of commutation valves to switch
  - from a first open and/or closed state combination, in which compression chambers of a first number of the compression chambers are serially connected to one another,
  - to a second open and/or closed state combination, in which compression chambers of a second number of the compression chambers are serially connected to one another, or vice-versa, wherein the first number of serially connected compression chambers is lower than the second number of serially connected compression chambers, such that a number of compression steps of the gas to be compressed increases when switching from the first to the second combination, and decreases when switching from the second to the first combination.

The method also comprises the steps of:

- prearranging a control unit;
- prearranging a first and a second pressure sensor respectively upstream and downstream of the reciprocating compressor;
- measuring a first pressure of the gas to be compressed and a second pressure of the compressed gas by the first and the second pressure sensors, respectively, and generating a first and a second signal of the first and of the second pressure, respectively, by the first and the second pressure sensors, respectively;
- receiving the first and the second pressure signals in the control unit;
- calculating, by the control unit, an overall pressure ratio of the second pressure signal to the first pressure signal;
- generating, by the control unit, a plurality of opening/closing control signals of the commutation valves responsive to the overall pressure ratio;
- transferring the opening/closing control signals to actuator elements of the commutation valves, wherein the opening/closing signals are configured in such a way that the commutation valves switch:

- from the first open and/or closed state combination to the second open and/or closed state combination when the overall pressure ratio becomes higher than a predetermined overall threshold value, and
- from the second open and/or closed state combination to the first open and/or closed state combination when the overall pressure ratio becomes lower than the overall threshold value.

This way, the step of causing the plurality of commutation valves to switch from the first open and/or closed state combination to the second open and/or closed state combination, or in any case from a possible combination to another combination corresponding to a larger number of serially connected compression chambers, is carried out when the overall pressure ratio becomes higher than said overall threshold value, while the step of causing the plurality of commutation valves to switch from the second open and/or closed state combination to the first open and/or closed state combination, or in any case from a possible combination to another combination corresponding to a smaller number of serially connected compression chambers, is carried out when the overall pressure ratio becomes lower than this threshold value.

In an advantageous exemplary embodiment, the method comprises the steps of:

- prearranging an upstream pressure sensor and a downstream pressure sensor upstream and downstream of each compression chamber, respectively;
- measuring an upstream pressure and a downstream pressure upstream and downstream of each compression chamber, by the upstream pressure sensor and the downstream pressure sensor, respectively, and generating upstream and downstream pressure signals, respectively, each by the upstream pressure sensor and the downstream pressure sensor, respectively;

receiving the upstream and downstream pressure signals in the control unit;

calculating, by the control unit, a plurality of single-step pressure ratios between the downstream pressure signals and respective upstream pressure signals, upstream and downstream of respective compression chambers;

generating, by the control unit, a plurality of opening/closing control signals of the commutation valves responsive to the single-step pressure ratios;

transferring the opening/closing control signals to actuator elements of the commutation valves, wherein the opening/closing signals are configured in such a way that the commutation valves switch:

from the first open and/or closed state combination to the second open and/or closed state combination when at least one of the single-step pressure ratios becomes higher than a predetermined single-step threshold value, and from the second open and/or closed state combination to the first open and/or closed state combination when at least one of the single-step pressure ratios becomes lower than the single-step threshold value.

According to another aspect of the invention, a device is provided comprising a plurality of commutation valves for changing the number of compression steps, each commutation valve configured to switch from a respective open status to a respective closed status, and vice-versa, wherein the commutation valves are arranged to switch:

from a first open and/or closed state combination, in which compression chambers of a first number of the compression chambers are serially connected to one another, to a second open and/or closed state combination, in which compression chambers of a second number of the compression chambers are serially connected to one another, wherein the first number of serially connected compression chambers is lower than the second number of serially connected compression chambers, and wherein each of such valves is configured to switch from the second open and/or closed state combination to the first open and/or closed state combination, such that a number of compression steps of the gas to be compressed increases when switching from the first to the second combination, and decreases when switching from the second to the first combination.

In other words, the first and the second open and/or closed state combinations of the commutation valves define two different numbers of paths for the gas to be compressed, and the gas passes through a different number of compression chambers, in particular in the path or paths corresponding to the second state combination the gas passes through a number of compression chambers that is larger than the number of compression chamber through which the gas passes in the paths corresponding to the first state combination. Therefore, by the second state combination, the gas is subjected to a larger number of compression steps and is compressed up to a higher pressure than by the first open and/or closed state combination of the valves.

In other words, by the second open and/or closed state combination the compression ratio of the compressor unit is higher than by the first open and/or closed state combination.

Obviously, embodiments are possible in which more than two open and/or closed state combinations of the commutation valves are defined and, accordingly, more than two connection modes of the compression chambers are possible corresponding to respective numbers of compression steps of the gas, each connection mode corresponding to a compression ratio of a plurality of compression ratios that can be provided by the reciprocating compressor unit, thanks to the device according to the invention.

Moreover, the device comprises:

a first pressure sensor arranged upstream of the reciprocating compressor and a second pressure sensor arranged downstream of the reciprocating compressor;

a control unit configured to:

receive a first pressure signal from first pressure sensor and a second pressure signal from the second pressure sensor;

calculate an overall pressure ratio of the second pressure signal to the first pressure signal;

generate a plurality of opening/closing control signals of the commutation valves responsive to the overall pressure ratio, wherein the control unit is arranged to transfer the opening/closing control signals to the actuator elements of the commutation valves, wherein said opening/closing signals are configured in such a way that the commutation valves switch from the first open and/or closed state combination to the second open and/or closed state combination, or in any case from a possible combination to another combination corresponding to a larger number of serially connected compression chambers, when the overall pressure ratio becomes higher than a predetermined overall threshold value, and from the second open and/or closed state combination to the first open and/or closed state combination, or in any case from a possible combination to another combination corresponding to a smaller number of serially connected compression chambers, when the overall pressure ratio becomes lower than the predetermined overall threshold value.

These features define an automatic way to change the number of compression steps to which the gas to be compressed is subjected and, accordingly, an automatic way to switch among the multiple compression ratios that can be provided by a reciprocating compressor equipped with the device. This automatic switch mode is advantageous in the case of normally unmanned installations, such as remotely controlled gas pipeline compression facilities.

In an advantageous exemplary embodiment, the device also comprises an upstream pressure sensor and a downstream pressure sensor arranged upstream and downstream of each compression chamber, respectively, and the control unit is configured to:

receive upstream pressure signals from each upstream pressure sensor and downstream pressure signals from each downstream pressure sensor;

calculate a plurality of single-step pressure ratios between the downstream pressure signals and respective upstream pressure signals, upstream and downstream of respective compression chambers;

generate a plurality of opening/closing control signals of the commutation valves responsive to the single-step pressure ratios;

transfer the opening/closing control signals to actuator elements of the commutation valves, wherein the opening/closing signals are configured in such a way that the commutation valves switch:

from the first open and/or closed state combination to the second open and/or closed state combination when at least one of the single-step pressure ratios becomes higher than a predetermined single-step threshold value, and from the second open and/or closed state combination to the first open and/or closed state combination when at least one of the single-step pressure ratios becomes lower than a predetermined single-step threshold value.

It also falls within the scope of the invention a reciprocating compression unit comprising the reciprocating compressor and the above-described device for changing the compression ratio thereof, associated to the compressor.

The gas to be compressed can be withdrawn, for instance, from a closed space from which the gas contained therein has to be evacuated, from an initial pressure to a final pressure, and the compressed gas is sent to a reception space at a predetermined working pressure that remains substantially unchanged at least during the compression steps of the gas to be compressed. As the gas evacuation proceeds, the pressure in the closed space, which is hermetical to the external gas apart from a connection with the inlet port of the compressor, decreases, while the pressure downstream of the reciprocating compressor remains unchanged. Therefore, as the evacuation proceeds, a continuously increasing compression ratio is required to the reciprocating compressor.

In a particular but common case, the closed space to be evacuated comprises a portion of a gas pipeline compression facility, typically including a main compressor of the gas pipeline, and the reception space is the gas pipeline itself, i.e. a section of the gas pipeline downstream of or in any case outside of the portion of the compression facility to be evacuated. The reciprocating compressor equipped with the device according to the invention makes it possible to recover the evacuated gas without substantially emitting it into the atmosphere, which is an economical and environmental advantage, for the reasons explained at the beginning of the present description.

In the case of a gas pipeline compression facility, the device can be associated to a possibly existing reciprocating compressor arranged to recover a lost gas leaking from the main compressor of the gas pipeline, in particular a lost gas leaking from a compressor seal, or in any case from possible leakage points of any closed space, during normal operation of the plant, or in any case while the reciprocating compressor performs an operation different from an evacuation of the closed space. Normally, the pressure of the leaked gas is only slightly higher than the atmospheric pressure. Therefore, a high compression ratio is required to compress the leaked gas up to the normal gas pipeline pressure and to introduce the leaked gas again into the pipeline. Therefore, during the substantially continuous step of recovering the leaked gas, the commutation valves are advantageously arranged in the second open and/or closed state combination, so as to obtain the maximum compression ratio that the reciprocating compressor can provide.

However, the device can be advantageously associated to any process plant reciprocating compressor that is installed between a suction environment at a suction pressure and a delivery environment at a delivery pressure, wherein the suction and delivery pressures can change to such an extent and in such a way that the pressure ratios changes in turn by at least one order of magnitude, and that a significant change of the compression ratio is required to the reciprocating compressor.

In an exemplary embodiment, the commutation valves are at least in part check valves, in particular disc check valves.

The device can comprise a housing box enclosing the commutation valves and configured to be mounted to the compressor. This makes it possible to easily associate the device of the invention to an existing reciprocating compressor, for example to a reciprocating compressor that is already in use in a gas pipeline compression facility for recovering leaked gas streams, as explained above. In particular, the connections to the compressor ducts are available on such a housing box. The control unit can be also arranged within the housing box, in which the electric and/or pneumatic connections required to operate the commutation valves are available.

BRIEF DESCRIPTION OF THE DRAWINGS

The invention is shown hereinafter through the description of some exemplary embodiments, exemplifying but not limitative, in which.

DESCRIPTION OF PREFERRED EXEMPLARY EMBODIMENTS

Figure 1:
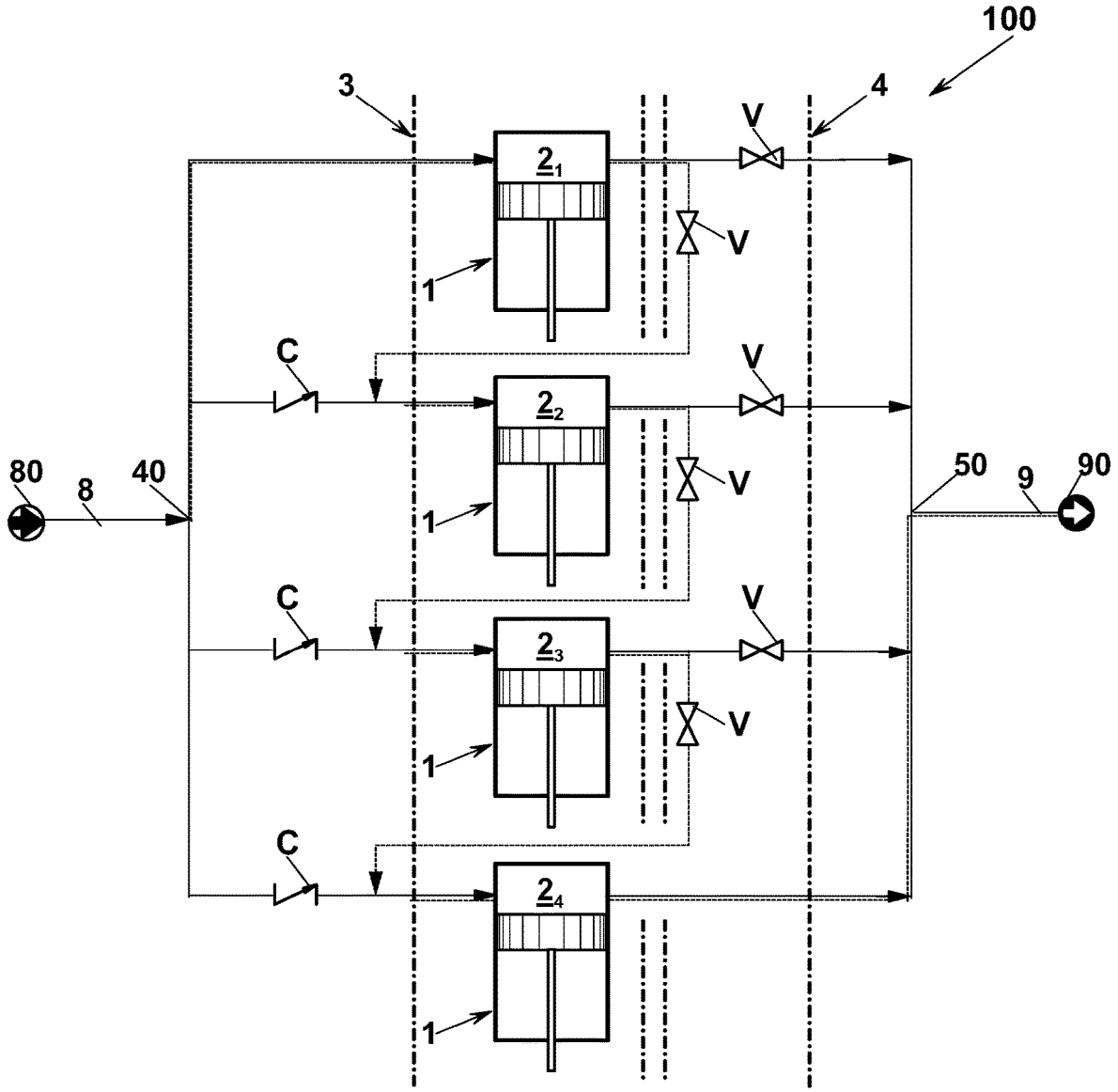
FIG. 1 is a diagram of a reciprocating compression unit, in which a reciprocating compressor includes a device for changing the compression ratio.
Figure 2:
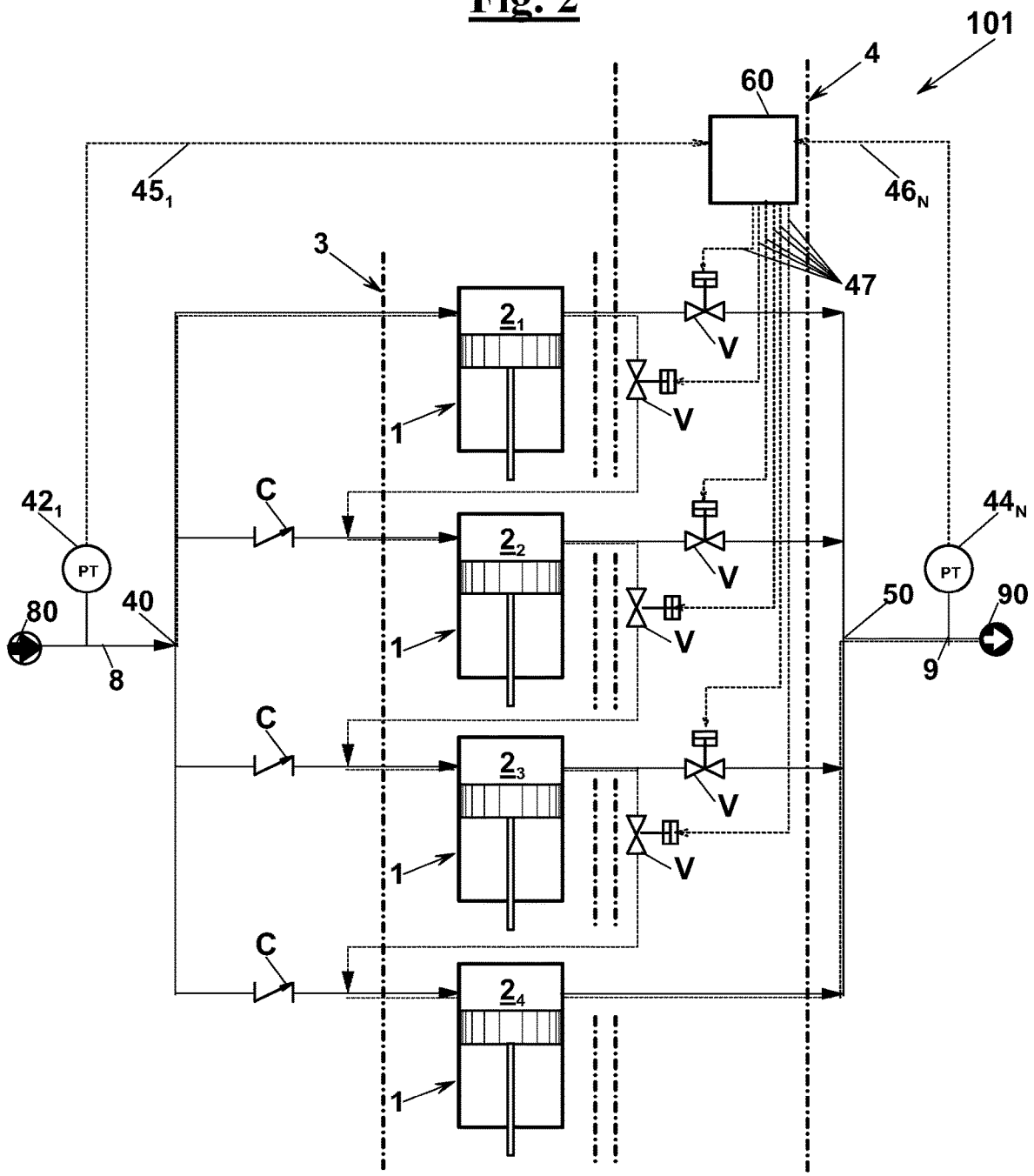
FIG. 2 is a diagram showing a compression unit similar to the compression unit of FIG. 1 and including a control unit for automatically adapting the compression ratio to the pressure conditions upstream and downstream of the compression unit.

With reference to FIGS. 1 and 2, a method and a device 4 are described for changing the compression ratio of a reciprocating compressor 3 comprising a plurality of piston-cylinder units 1 defining a plurality, i.e. a number N, of compression chambers $\mathbf{2}_i$, i=1 . . . 4 pneumatically connected between an inlet port 40 and an outlet port 50 of reciprocating compressor 3. Compression units 100 and 101 are also described comprising compressor 3 and device 4. In the case of FIGS. 1 and 2, reciprocating compressor 3 comprises a number N equal to four of compression chambers $\mathbf{2}_i$, i.e. i=1 . . . 4.

Device 4 comprises a plurality of commutation valves V for changing the number of compression steps to which a same volume of gas is subjected by reciprocating compressor 3. Commutation valves V are arranged in such a way that the number of serially connected compression chambers $\mathbf{2}_i$ increases when turning from a first open and/or closed state combination to a second open and/or closed state combination of the valves, and therefore the number of parallel connected compression chambers $\mathbf{2}_i$ decreases.

In particular, in FIGS. 1 and 2, a first open and/or closed state combination of valves V corresponds to the path marked by a continuous line. In these conditions, all four compression chambers 2 are parallel connected to each other, so the number N of serially connected compression chambers 2 is one. In this case, a same volume of gas to be compressed coming from a suction environment 80 through inlet port 40 of reciprocating compressor 3 is subjected to a single compression step in a respective compression chamber $\mathbf{2}_i$. In other words, with this open and/or closed state combination of valves V, compression units 100 and 101 are in a single-compression-steps configuration.

A second open and/or closed state combination of valves V corresponds to the path marked by a dashed line. In those conditions, all four compression chambers $\mathbf{2}_i$ are serially connected to each other, and there are no parallel connected compression chambers. In this case, a same volume of gas to be compressed 8 coming from suction environment 80 through inlet port 40 of reciprocating compressor 3 is subjected to four compression steps by sequentially crossing all four compression chambers $\mathbf{2}_i$. In other words, with this open and/or closed state combination of valves V, compression units 100 and 101 are in a four-compression-steps configuration.

For the sake of simplicity, FIGS. 1 and 2 do not show a two-compression-steps configuration, in which, for instance, compression chambers $\mathbf{2}_1$ and $\mathbf{2}_2$ are connected serially to each other and compression chambers $\mathbf{2}_3$ and $\mathbf{2}_4$ are connected serially to each other, and the series of compression chambers $\mathbf{2}_i$ and $\mathbf{2}_2$ is parallel connected to the series of compression chambers $\mathbf{2}_3$ and $\mathbf{2}_4$. Also omitted is the representation of a three compression-step-configuration, in which, for instance, compression chambers $\mathbf{2}_1$ and $\mathbf{2}_2$ are connected serially to each other and compression chambers $\mathbf{2}_3$ and $\mathbf{2}_4$ are connected parallel to each other, and the series of compression chambers $\mathbf{2}_1$ and $\mathbf{2}_2$ is parallel connected to both compression chambers $\mathbf{2}_3$ and $\mathbf{2}_4$. These further configurations can be obtained by respective open and/or closed state combination of valves V that can be deducted in an obvious way from FIGS. 1 and 2.

As shown in FIG. 2, device 4 for changing the compression ratio also comprises a first suction pressure sensor $\mathbf{42}_1$, i.e., a pressure sensor arranged upstream of reciprocating compressor 3, and a second delivery pressure sensor $\mathbf{44}_N$, arranged downstream of reciprocating compressor 3. Device 4 also comprises a control unit 60 configured to receive a first pressure signal $\mathbf{45}_1$ from first pressure sensor $\mathbf{42}_1$ and a second pressure signal $\mathbf{46}_N$ from second delivery pressure sensor $\mathbf{44}_N$ i.e., arranged downstream of reciprocating compressor 3. Control unit 60 is also configured to calculate a current ratio between the delivery pressure and the suction pressure from pressure signals $\mathbf{45}_1$, $\mathbf{46}_N$, i.e., to calculate an overall pressure ratio of the compression unit, to generate opening/closing control signals 47 and to transfer the latter to respective actuators of commutation valves V. Advantageously, pressure signals $\mathbf{45}_1$, $\mathbf{46}_N$ and control signals 47 are all shown by dashed lines, regardless of their pneumatic or electric nature, and possible electro/pneumatic transducers are not shown, and vice-versa.

Opening/closing signals 47 are configured in such a way that the commutation valves switch from the first to the second above-mentioned open and/or closed state combination when the overall pressure ratio becomes higher than a predetermined overall threshold value, and switch from the second to the first open and/or closed state combination when, on the contrary, the overall pressure ratio becomes lower than a predetermined overall threshold value. These open and/or closed state combination can be combinations corresponding to a one-compression-steps configuration and to a two-compression-steps configuration, respectively, or corresponding to a two-compression-steps configuration and to a three-compression-steps configuration, respectively, or corresponding to a three-compression-steps configuration and to a four-compression-steps configuration, respectively.

Figure 3:
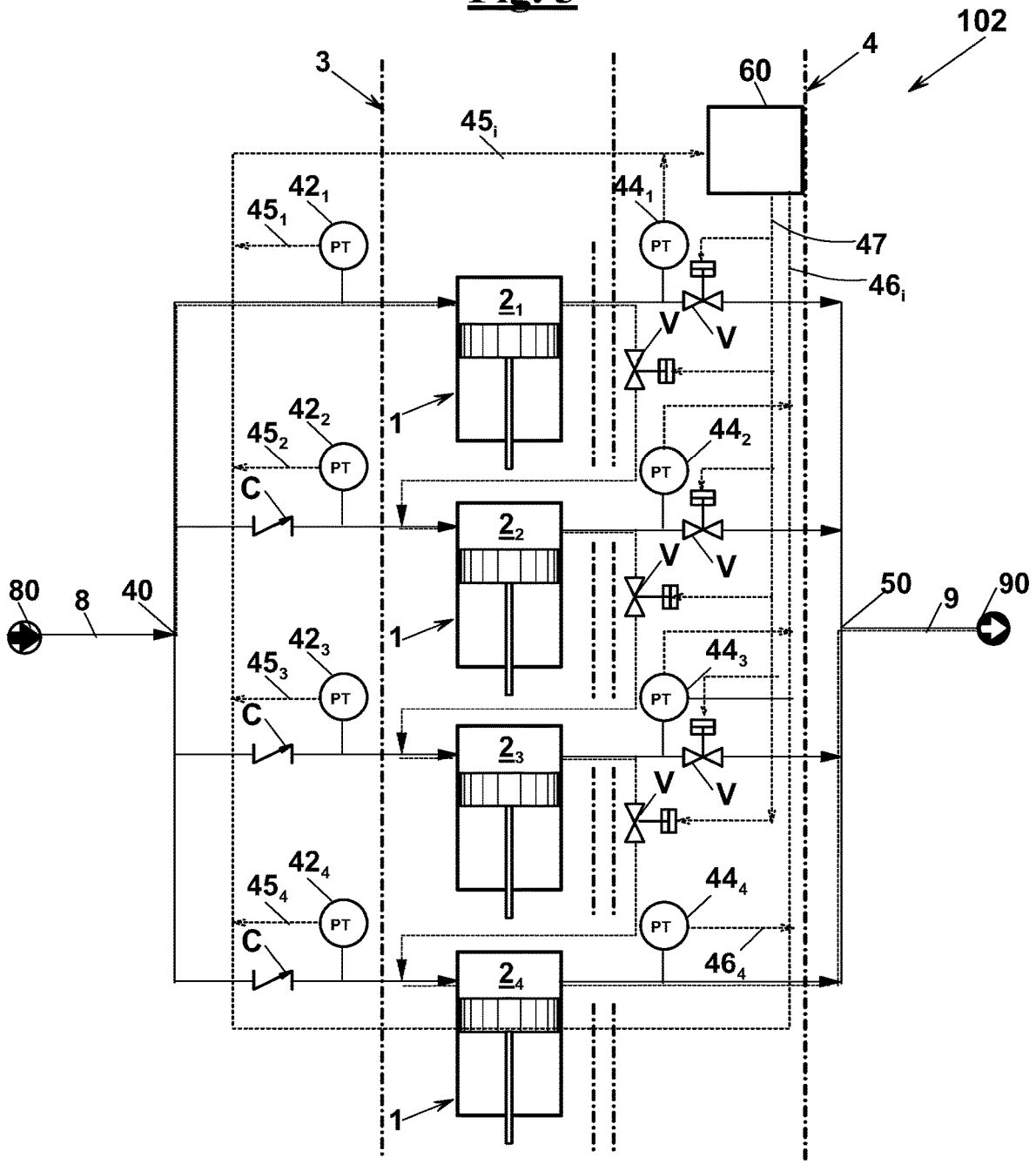
FIG. 3 is a diagram showing a compression unit similar to the compression unit of FIG. 1 and including a control unit for automatically adapting the compression ratio to the pressure conditions upstream and downstream of each compression chamber of the compression unit.

FIG. 3 is a diagram showing a compression unit 102 similar to compression units 100, 101 of FIGS. 1 and 2, in which control unit 60 is configured to automatically adapt the compression ratio responsive to the pressure conditions upstream and downstream of each compression chamber $\mathbf{2}_i$, instead of responsive to the pressure conditions upstream and downstream of the whole reciprocating compressor 3, as in the case of compression unit 101 of FIG. 2.

In this case, more in detail, device 4 comprises a plurality of further upstream pressure sensors $\mathbf{42}_i$, i=2 . . . 4 and a plurality of further downstream pressure sensors $\mathbf{44}_i$, i=1 . . . 3 in addition to first pressure sensor $\mathbf{42}_1$ upstream of reciprocating compressor 3, i.e., upstream of first compression chamber $\mathbf{2}_1$, and in addition to second pressure sensor $\mathbf{44}_N$ downstream of compressor 3, i.e., downstream of $N^{th}$, i.e. of fourth compression chamber $\mathbf{2}_N$, where N=4, so that N upstream pressure sensors $\mathbf{42}_i$ and N downstream pressure sensors $\mathbf{44}_i$ are overall provided upstream and downstream of each compression chamber $\mathbf{2}_i$, respectively. Moreover, control unit 60 is configured to receive upstream pressure signals $\mathbf{45}_i$ from each upstream pressure sensor $\mathbf{42}_i$ and downstream pressure signals $\mathbf{46}_i$ from each downstream pressure sensor $\mathbf{44}_i$, and to calculate single-step pressure ratios, i.e. downstream-to-upstream pressure ratios, for each compression chamber $\mathbf{2}_i$, between each downstream pressure signal $\mathbf{46}_i$ and corresponding upstream pressure signal $\mathbf{45}_i$. Control unit 60 is also configured to generate opening/closing control signals 47 of commutation valves V responsive to the calculated single-step pressure ratios, and to transfer opening/closing control signals 47 to actuator elements of commutation valves V. Opening/closing signals 47 are configured in such a way that commutation valves V switch from the first to the second above-mentioned open and/or closed state combination, when at least one of the single-step pressure ratios becomes higher than a predetermined single-step threshold value, and switch from the second to the first open and/or closed state combination when, instead, at least one of the single-step pressure ratios becomes lower than a predetermined single-step threshold value. The threshold values of the two switches can be different from each other. In particular, these threshold values are about 3.

In FIG. 3, pressure sensors $\mathbf{42}_i$ and $\mathbf{44}_N$ are associated to digital transmitters communicating with control unit 60 via a common bus connection. Control unit 60 can communicate with the actuator elements of valves V in a similar way.

The compression chambers can be compression chambers of respective single-action piston-cylinder units 1 or, advantageously, they can be two-by-two coupled as compression chambers of a same double-action piston-cylinder unit, as described hereinafter with reference to FIGS. 7 and 8.

Figure 4:
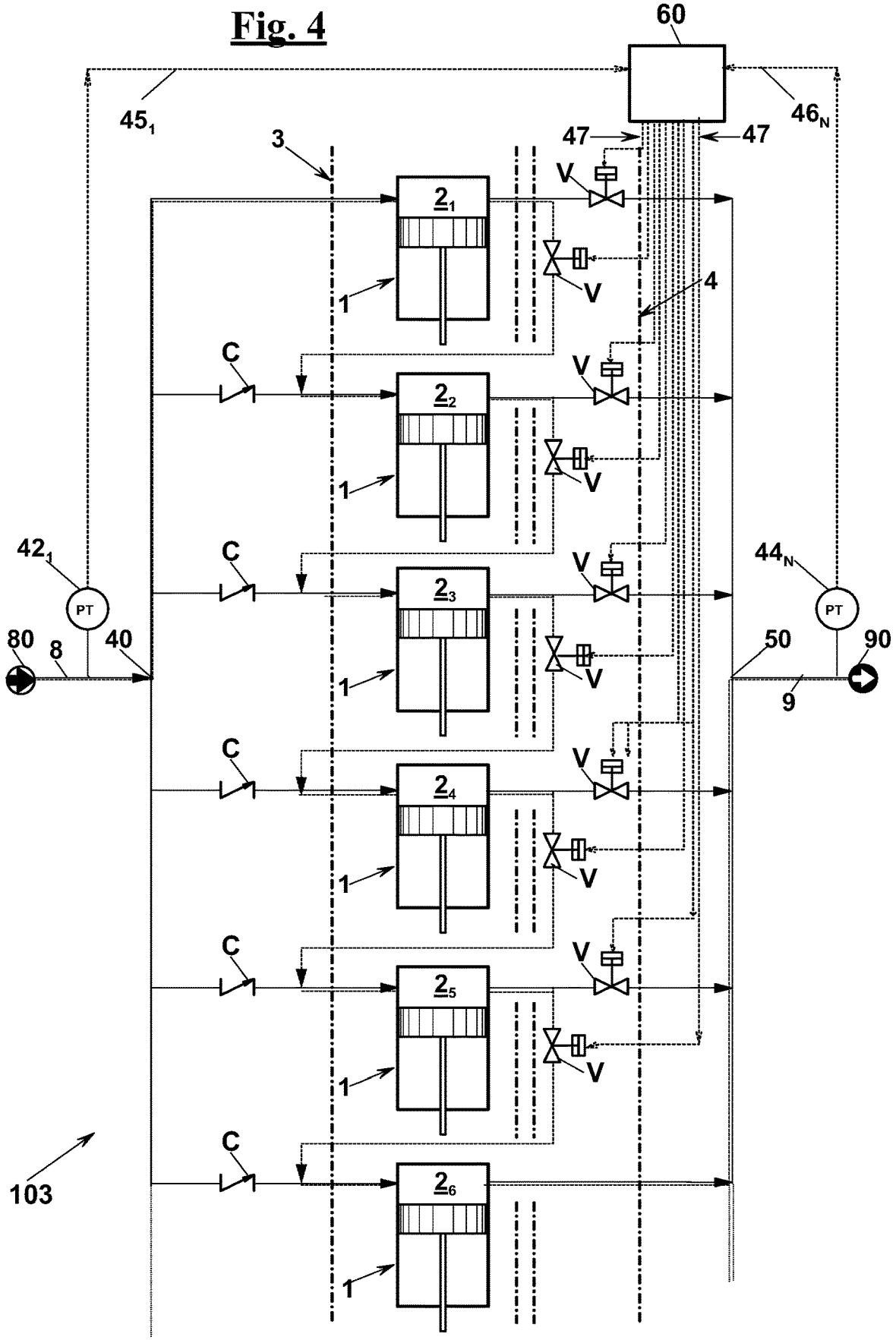
FIG. 4 is a diagram showing a compression unit that is similar to the compression unit of FIG. 2, but includes a larger number of compression chambers.

Moreover, the invention is not limited to the preferred exemplary embodiment of FIGS. 1-3, in which the compressor has four compression chambers $\mathbf{2}_i$, but can comprise a preferably even larger number of compression chambers. For instance, FIG. 4 diagrammatically shows a compression unit 103 that is similar to compression unit 101 of FIG. 2, but differs therefrom by a larger number N of compression chambers $\mathbf{2}_i$, i=1 . . . N, for example N=6 compression chambers $\mathbf{2}_i$, or even more than 6 compression chambers, as diagrammatically shown by the dashed-line lower part of FIG. 4 itself.

Even in this case, a first open and/or closed state combination of valves V corresponds to the path marked by a continuous line. In these conditions, all at least six compression chambers $\mathbf{2}_i$ are parallel connected to each other, so the number N of serially connected compression chambers $\mathbf{2}_i$ is one. In this case, a same volume of gas coming from suction environment 80 through inlet port 40 of reciprocating compressor 3 is subjected to a single compression step in a respective compression chamber $\mathbf{2}_i$. In other words, by this open and/or closed state combination of valves V, compression unit 103 comprising compressor 3 and device 4 is in a single-compression-steps configuration.

A second open and/or closed state combination of valves V corresponds to the path marked by a dashed line. In those conditions, all at least six compression chambers $\mathbf{2}_i$ are serially connected to each other, and there are no parallel connected compression chambers. In this case, a volume of gas coming from suction environment 80 through inlet port 40 of reciprocating compressor 3 is subjected to at least six compression steps crossing in turn all six or more compression chambers $\mathbf{2}_i$. In other words, by this open and/or closed state combination of valves V, compression unit 103 is in a six(at least)-compression-step configuration.

Even in this case, advantageously, only the configurations are shown that correspond to the minimum number of compression steps, i.e., 1, by the continuous line, and to the maximum number of compression steps, i.e., 6, by a dashed line, since the other possible configurations can be easily deducted from the drawing.

Figure 5:
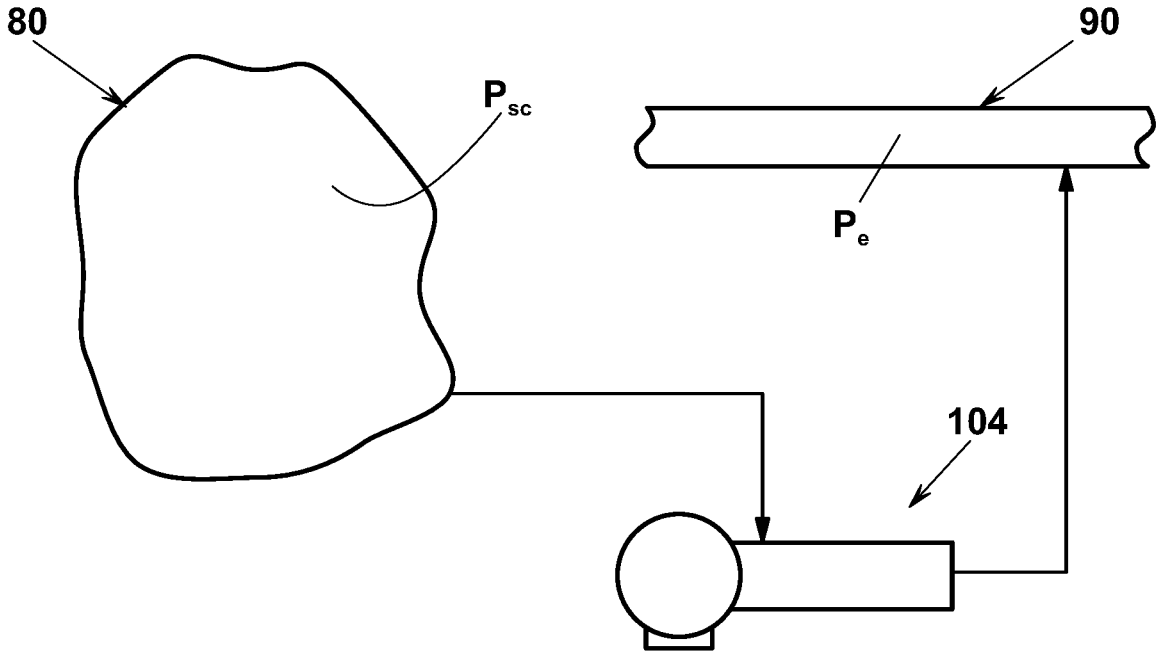
FIG. 5 diagrammatically shows a compression unit arranged between a closed space to be evacuated and a reception space for the gas evacuated from the closed space.
Figure 6:
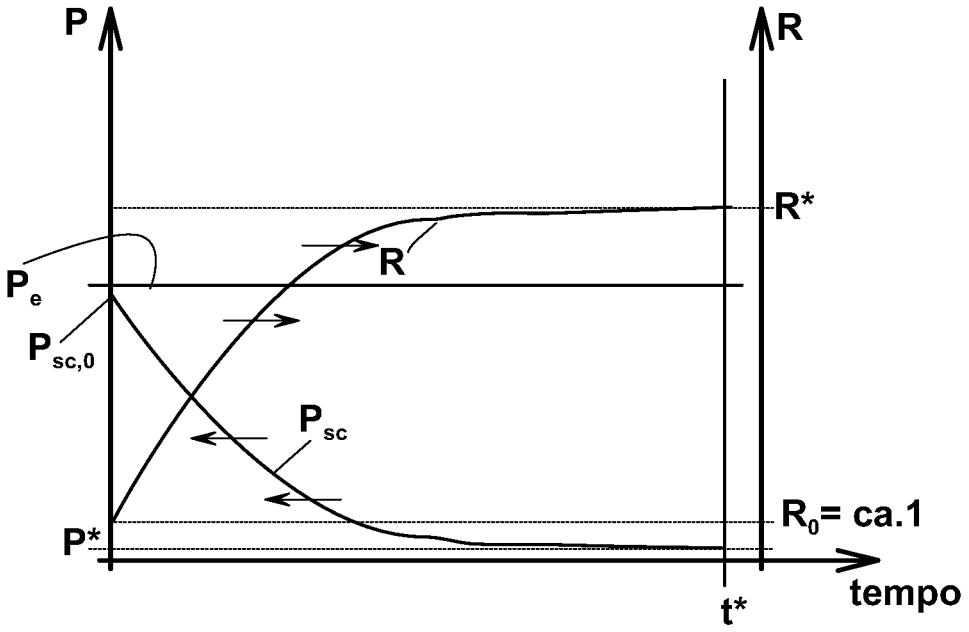
FIG. 6 is a diagram showing how the pressure changes in a closed space evacuated while evacuating it into a constant pressure reception space, and how the pressure ratio of the closed space to the reception space evolves while the evacuation is in progress.

As diagrammatically shown in FIG. 5, an application of the method, of device 3 and of compression unit 104, which can be for instance one of the above-described compression units 101, 102, 103, consists in evacuating a gas at an initial pressure $P_{sc,0}$ from a closed suction space 80 to a delivery or reception space 90 in which the same gas is at a predetermined working pressure $P_e$. This is a typical industrial application, in which closed space 80 can be in a stop condition for some operation and/or for maintenance reasons. As shown in FIG. 6, as the gas evacuation proceeds, pressure $P_{SC}$ in closed space 80 decreases down to a predetermined final value P* at time t*, which is the total evacuation time. Compression ratio R required to compression unit 104 correspondingly increases from a value that is about 1 at time 0 when evacuation begins, up to a final value R*.

As an example, in the following part of the description, reference is made to a closed space 80 that is a section of a compression facility of a gas pipeline comprising a main compressor, while reception space 90 is the gas pipeline itself, at working pressure $P_e$, which remains substantially unchanged. However, closed space 80 can also be a section of an LNG plant, or of a $CO_2$ recovery and storage plant, or of any technical gas production and storage/distribution plant, or even of a chemical or petrochemical plant, such as a polyolefin production facility, or of any plant where a high-pressure harmful or valuable gas is treated.

In all those applications, initial pressure $P_{sc,0}$ in closed space 80, i.e., the initial suction pressure of compression unit 104, can be a value set between 25 and 60 bar, in particular 30 and 50 bar, depending on the plant. The predetermined final pressure P* at the end of the evacuation is normally set between 0,1 and 0,2 bar gauge. Pressure $P_e$ in reception space, for example in gas pipeline 90, i.e., the delivery pressure required to compression unit 104, is generally set between 40 and 200 bar gauge. Therefore, as the evacuation of closed space 80 proceeds, the required compression ratio changes from a value $R_0=P_e/P_{sc,0}$, which is generally slightly higher than one, or is the same order of magnitude as one, at the beginning of the evacuation, up to a value $R^*=P_e/P^*$, which is generally a few tenths and in some instances about 100, to be achieved at the end of the gas evacuation and conveying process.

As the evacuation proceeds, the evacuation flowrate changes as well. The flowrate can be predetermined by selecting the size of compressor 3, so as to obtain, taking into account the size of plant section 80 to be evacuated, a predetermined total evacuation time t*, which is normally set between 4 and 24 hours. Normally, this flowrate is lower than 500 Kg/h at the beginning of the evacuation.

Figure 9:
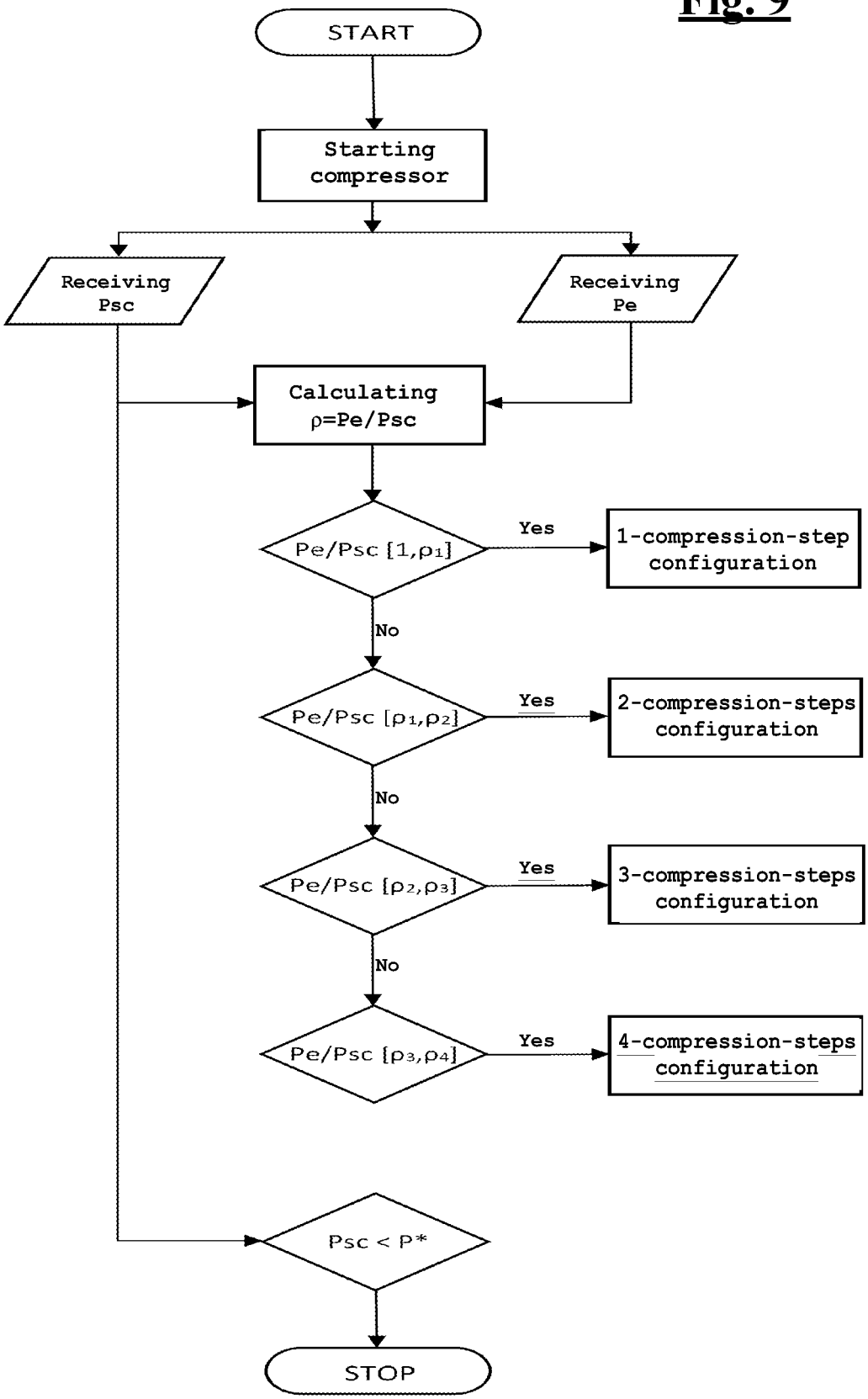
FIG. 9 is a simplified block diagram of the process for the control unit to adjust the number of compression steps, and the compression ratio accordingly.

FIG. 9 is a simplified block diagram of the process carried out by the control unit for adjusting the number of compression steps, and therefore the compression ratio, the meaning of the symbols being deducible from the previous description. $\rho_1$, $\rho_2$, $\rho_3$, $\rho_4$ refer to predetermined of pressure ratios $P_e$ in reception space 90 to pressure $P_{SC}$ in closed space 80 below which the required number of compression steps is 1, 2, 3 and 4, respectively.

Figure 7:
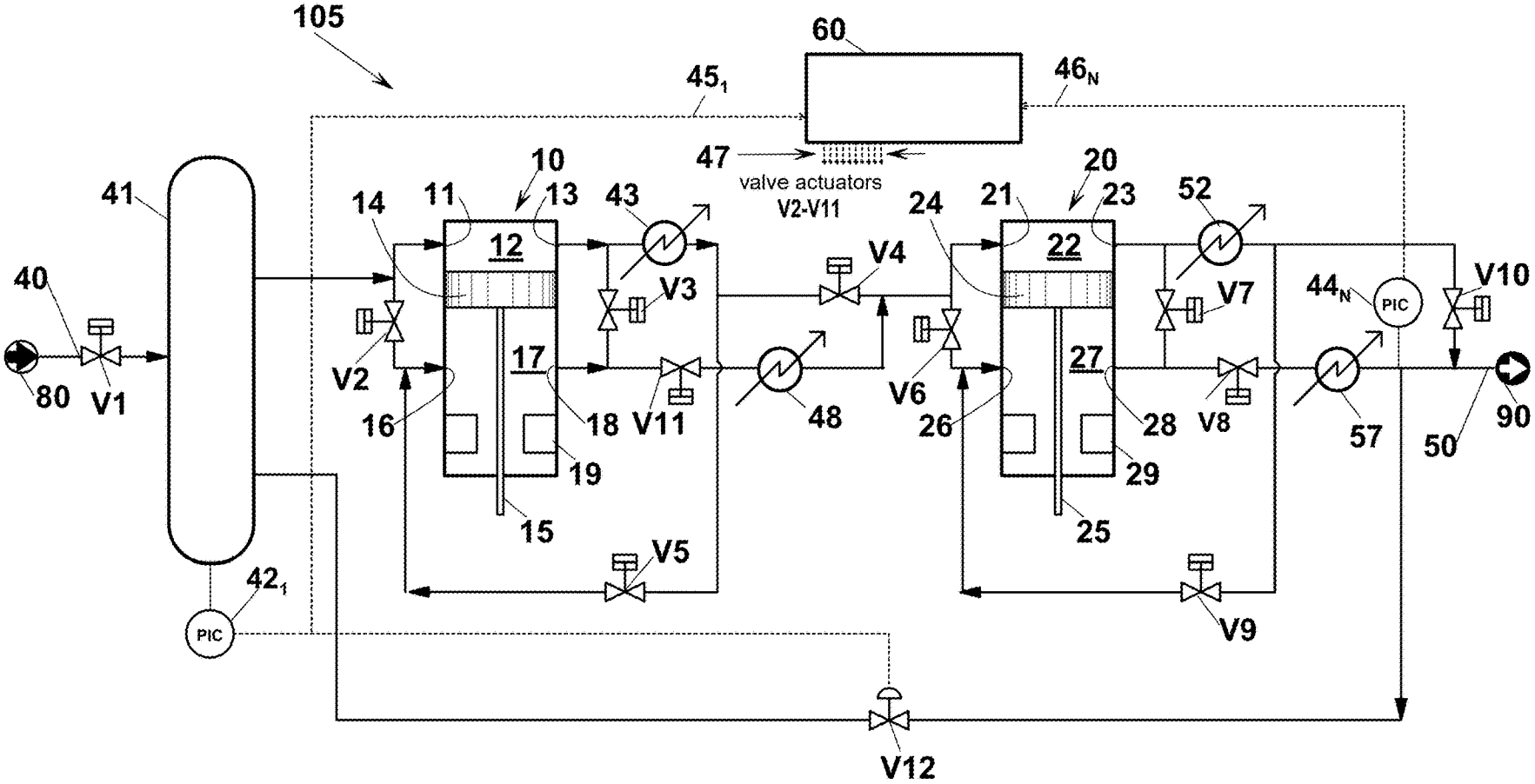
FIG. 7 is a diagram showing a compression unit according to an exemplary embodiment of the invention, i.e. of a device for changing the compression ratio thereof, comprising two double-acting single-bore piston-cylinder units.
Figure 8:
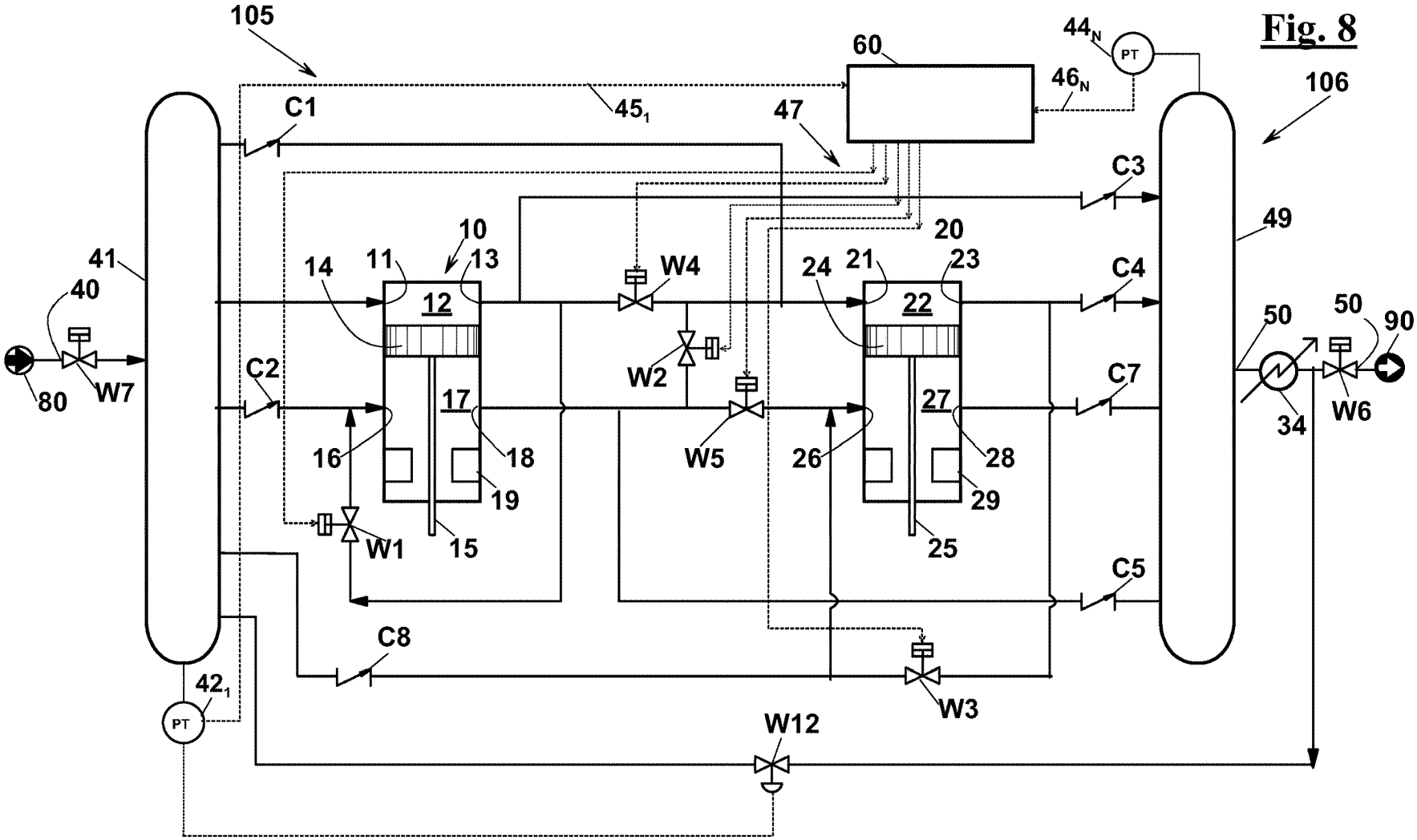
FIG. 8 is a diagram showing a compression unit according to an exemplary embodiment of the invention, including two double-acting double-bore piston-cylinder units.

As shown in FIGS. 7 and 8, the reciprocating compressor of a compression unit 105 according to two exemplary embodiments comprises two cylinder-piston units 10, 20 including respective double-acting cylinders 19, 29. This way, both strokes of respective pistons 14, 24 are used to convey the gas from the suction space 80 to delivery space 90. Such an arrangement reduces the overall size of cylinder-piston units 10, 20 and therefore reduces the reciprocating compressor overall size.

Pistons 14, 24 are preferably connected to a crankshaft, not shown, through respective connecting rods 15, 25, in a conventional way. Accordingly, pistons 14, 24 are arranged to define compression chambers 12, 17 and 22, 27 within cylinders 19, 29, respectively, and to reciprocate within cylinders 19, 29 opposite to each other. In other words, when piston 14 compresses the volume of compression chamber 12 opposite to connecting rod 15 (direct stroke), piston 24 compresses the volume of compression chamber 27 on the same side as connecting rod 25 (backstroke). On the contrary, when piston 14 compresses the volume of compression chamber 17 on the same side as rod 15 (backstroke), piston 24 compresses the volume of compression chamber 22 opposite to connecting rod 25 (direct stroke).

FIGS. 7 and 8 also indicate the positions of suction valves 11, 16, 21, 26 and of delivery valves 13, 18, 23, 28 of compression chambers 12, 17, 22, 27, respectively, whose open status or closed status depends on upstream to downstream pressure difference of the valve, as well known.

FIG. 7 relates to an exemplary embodiment of device 4 or of compression unit 105 according to the invention, in which reciprocating compressor 4 comprises cylinder-piston units 10, 20 with single-bore cylinders 19, 29. Such an embodiment is advantageous if particularly high compression ratios are required, for example if the delivery pressure $P_e$ is higher than 100 bar and the final/minimum suction pressures is about 0,1-0,2 bar gauge. In fact, the embodiment with single-bore cylinders allows a higher number of compression steps.

In addition to cylinder-piston units 10, 20, compression unit 105 can comprise a feed tank 41, a shut-off valve V1 arranged upstream of feed tank 41, configured to remain open in any working condition of compression unit 105, a plurality of heat exchangers 43, 48, 52, 57 arranged to cool the gas leaving respective compression chambers 12, 17, 22, 27, and a conventional recycle valve V12 to maintain the pressure upstream of the reciprocating compressor of compression unit 105 above a predetermined value. Recycle valve V12 can be a modulating regulation valve whose opening degree is normally set responsive to the gas intake pressure of compression unit 105, typically by a pressure sensor 42 arranged on feed tank 41 and associated to a pressure regulator PIC.

For example, commutation valves V2-V11 are configured to open and close in such a way to set a two-compression-steps working condition, i.e. a condition in which a same intake gas volume is subjected to two compression steps, or a four-compression-steps working condition, i.e. a condition in which a same intake gas volume is subjected to four compression steps. More in detail, in the two-compression-steps working condition:

valves V11, V5, V8, V9 are closed, while valves V2, V3, V4, V6, V7, V10 are open.

This way, two paths are defined for the gas fed through shut-off valve V1 and feed tank 41.

In fact, when pistons 14, 24 of the first and of the second cylinder-piston units 10, 20 perform a backstroke and a direct stroke, respectively, an amount of gas is withdrawn from feed tank 41 into compression chamber 12 through intake valve 11, while the gas present in compression chamber 17 is transferred into compression chamber 27 through open valves 18, V3, V4, V6 and 26, and the gas present in compression chamber 22 is expelled out of compression unit 105 through valves 23 and V10. Instead, when pistons 14, 24 of the first and of the second cylinder-piston units 10, 20 perform a direct stroke and a backstroke, respectively, an amount of gas is withdrawn from feed tank 41 into compression chamber 17 through valves V2 and 16, while the gas present in compression chamber 12 is transferred into compression chamber 22 through open valves 13, V4 and 21, and the gas present in compression chamber 27 is expelled out of compression unit 105 through valves 28, V7 and V10.

Therefore, a same volume of gas sucked into compression chamber 12 passes through a first path sequentially defined by elements 11, 12, 13, V4, 21, 22, 23, V10 and is subjected to two compression steps in compression chambers 12 and 22 during the three subsequent backstroke-direct stroke-backstroke of piston 14, while a same volume of gas sucked into compression chamber 17 passes through a second path sequentially defined by elements V2, 16, 17, 18, V3, V4, V6, 26, 27, 28, V7 and V10 and is subjected to two compression steps in compression chambers 17 and 27 during the three subsequent direct stroke-backstroke-direct stroke of piston 14. Therefore, with this open and/or closed state combination of commutation valves V2-V11, the gas withdrawn by compression unit 105 from tank 41 is subjected in any case to two compression steps.

Instead, in the four-compression-steps working condition:

valves V2, V3, V4, V6, V7, V10 are closed, while valves V11, V5, V8, V9 are open.

This way, a single path is defined for the gas fed through shut-off valve V1 and feed tank 41.

In fact, when pistons 14, 24 of the first and of the second cylinder-piston units 10, 20 perform a backstroke and a direct stroke, respectively, an amount of gas is withdrawn from feed tank 41 into compression chamber 12 through intake valve 11, while the gas present in compression chamber 17 is transferred into compression chamber 22 through open valves 18, V11, 22 and the gas present in the compression chamber 26 is expelled out of compression unit 105 through valves 28 and V8. Instead, when pistons 14, 24 of the first and of the second cylinder-piston units 10, 20 perform a direct stroke and a backstroke, respectively, the gas present in compression chamber 12 is transferred into compression chamber 17 through valves 13, V5 and 16, V2 and 16, while the gas present in compression chamber 12 is transferred into compression chamber 22 through open valves 13, V4 and 21, and the gas present in compression chamber 27 is expelled out of compression unit 105 through valves 28, V7 and V10.

Therefore, with this open and/or closed state combination of commutation valves V2-V11, a same volume of gas sucked into compression chamber 12 from tank 41 passes through a single path sequentially defined by elements 11, 12, 13, V5, 16, 17, 18V11, 21, 22, 23, V9, 26, 27.28, V8, in five subsequent backstroke-direct stroke-backstroke-direct stroke-backstroke of piston 14 and is subjected to four compression steps.

FIG. 8 relates to an exemplary embodiment where the reciprocating compressor of compression unit 106 comprises cylinder-piston units 10, 20 with double-bore cylinders 19, 29. In comparison with the case of the single-bore cylinders, this allows a more accurate force balance and a more accurate lubrication of the internal parts of the compressor. This embodiment is therefore preferable when the required compression ratios are not so extremely high as in the previous case, and when the gas transfer must be carried out in a very short time, for instance, when reception space 90 is at a pressure $P_e$ lower than about 70 bar, under a same final/minimum suction pressure of about 0,1-0,2 bar gauge.

Besides cylinder-piston units 10, 20 and feed tank 41, compression unit 106 comprises a delivery tank 49, two shut-off valves W7 and W6 arranged respectively upstream of feed tank 41 and downstream of delivery tank 49, configured to remain open in any working condition of compression unit 106, and also comprises a plurality of heat exchangers, not shown, arranged to cool the gas coming out from respective compression chambers 12, 17, 22, 27. A conventional recycle valve W8 is also provided for maintaining the upstream pressure of the compressor of compression unit 106 above a predetermined value. Recycle valve W8 can have the shape of a modulating regulation valve whose opening degree is normally set responsive to the gas intake pressure of compression unit 106, typically by a pressure sensor arranged on feed tank 41 and associated to a pressure regulator PIC.

Compression unit 106 also comprises a plurality of check valves C1-C7, preferably disc-type check valves.

Commutation valves W1-W5 are configured to open and close in such a way to select, for instance, a single-compression-step working condition, i.e., a working condition in which a same volume of sucked gas is subjected to a single compression step, or a two-compression-steps working condition, i.e., a working condition in which a same volume of sucked gas is subjected to two compression steps, or even a four-compression-steps working condition, i.e., a working condition in which a same volume of sucked gas is subjected to four compression steps.

More in detail, in the single-compression-step working condition, all commutation valves W1-W5 are closed. This way, four paths are defined for the gas fed through shut-off valve W7 and feed tank 41.

In fact, when pistons 14, 24 of the first and of the second cylinder-piston units 10, 20 perform a backstroke and a direct stroke, respectively, an amount of gas is withdrawn from feed tank 41 into compression chambers 12 and 27 directly and through check valve C6, respectively, while the gas present in compression chambers 17 and 22 is pushed into delivery tank 49 at the outlet of compression unit 106 through check valves C5 and C4, respectively. Instead, when pistons 14, 24 of the first and of the second cylinder-piston units 10, 20 perform a direct stroke and a backstroke, respectively, an amount of gas is withdrawn from feed tank 41 into compression chambers 17 and 22 through check valve C3 and directly, respectively.

Therefore,

- a same volume of gas sucked into compression chamber 12 passes through a first path sequentially defined by elements 11, 12, 13, C3, 49, W6 and is subjected to a single compression step in compression chamber 12 during the three subsequent backstroke-direct stroke-backstroke of piston 14;
- a same volume of gas sucked into compression chamber 27 passes through a second path sequentially defined by elements C6, 26, 27, 28, 49, W6 and is subjected to a single compression step in compression chamber 27 during the three subsequent backstroke-direct stroke-backstroke of piston 14;
- a same volume of gas sucked into compression chamber 17 passes through a third path sequentially defined by elements C2, 16, 17, 18, C5, 49, W6 and is subjected to a single compression step in compression chamber 17 during the three subsequent direct stroke-backstroke-direct stroke of piston 14;
- a same volume of gas sucked into compression chamber 22 passes through a fourth path sequentially defined by elements C1, 21, 22, 23, C4, 49, W6 and is subjected to a single compression step in compression chamber 22 during the three subsequent direct stroke-backstroke-direct stroke of piston 14.

Therefore, with this open and/or closed state combination of commutation valves W1-V5, the gas withdrawn by compression unit 106 from tank 41 is subjected in any case to a single compression step.

Instead, in the two-compression-steps working condition:

valves W1, W2, W3 are closed, while valves W4, W5 are open.

This way, two paths are defined for the gas fed through shut-off valve W7 and feed tank 41.

In fact, when pistons 14, 24 of the first and of the second cylinder-piston units 10, 20 perform a backstroke and a direct stroke, respectively, an amount of gas is withdrawn from feed tank 41 into compression chamber 12 through intake valve 11, while the gas present in compression chamber 17 is transferred into compression chamber 27 through open valves 18, W5, 26, and the gas present in compression chamber 22 is expelled out of compression unit 106 through valves 23 and C4. Instead, when pistons 14, 24 of the first and of the second cylinder-piston units 10, 20 perform a direct stroke and a backstroke, respectively, an amount of gas is withdrawn from feed tank 41 into compression chamber 17 through valves C2 and 16, while the gas present in compression chamber 12 is transferred into compression chamber 22 through open valves 13, W4 and 21, and the gas present in compression chamber 27 is expelled out of compression unit 106 through valve 28.

Therefore, a same volume of gas sucked into compression chamber 12 passes through a first path sequentially defined by elements 11, 12, 13, W4, 21, 22, 23, C4 and is subjected to two compression steps in compression chambers 12 and 22, during the three subsequent backstroke-direct stroke-backstroke of piston 14, while a same volume of gas sucked into compression chamber 17 passes through a second path sequentially defined by elements C2, 16, 17, 18, W5, 26, 27, 28 and is subjected to two compression steps in compression chambers 17 and 27, during the three subsequent direct stroke-backstroke-direct stroke of piston 14. Therefore, with this open and/or closed state combination of commutation valves W1-V5, the gas withdrawn by compression unit 106 from tank 41 is subjected in any case to two compression steps.

Instead, in the four-compression-steps working condition:

valves W4, W5 are closed while valves W1, W2, W3 are open.

This way, two paths are defined for the gas fed through shut-off valve W7 and feed tank 41.

In fact, when pistons 14, 24 of the first and of the second cylinder-piston units 10, 20 perform a backstroke and a direct stroke, respectively,

- an amount of gas is sucked from feed tank 41 into compression chamber 12 through intake valve 11, while
- the gas present in compression chamber 17 is transferred into compression chamber 22 through open valves 18, W2, 21, and
- the gas present in compression chamber 22 is transferred into compression chamber 27 through open valves W3 and 26.

Instead, when pistons 14, 24 of the first and of the second cylinder-piston units 10, 20 perform a direct stroke and a backstroke, respectively,

- the gas present in compression chamber 12 is transferred into compression chamber 17 through open valves 13, W1 and 16, and
- the gas present in compression chamber 27 is expelled out of compression unit 106 through valve 28.

Therefore, with this open and/or closed state combination of commutation valves W1-V5, the gas withdrawn by compression unit 106 from tank 41 is subjected in any case to four compression steps.

In compression unit 106, a cross arrangement of the compression steps is preferred, in order to balance at best the forces exerted by the pistons on the compressor structure.

As shown in FIGS. 7 and 8, compression unit 105, 106, i.e. device 4 for changing the compression ratio thereof, also comprises a control unit 60 configured to receive a first pressure signal $\mathbf{45}_1$ from upstream pressure sensor $\mathbf{42}_1$ and a second pressure signal $\mathbf{46}_N$ from a downstream pressure sensor $\mathbf{44}_N$ upstream and downstream of compression unit 105, 106, respectively, to calculate a current ratio between the delivery pressure and the suction pressure from the first and from the second pressure signals $\mathbf{42}_1$, $\mathbf{46}_N$, i.e. to calculate an overall pressure ratio, to generate opening/closing control signals 47 and to transfer them to actuators of valves V2-V11 (FIG. 7) and W2-W5 (FIG. 8). Pressure signals $\mathbf{45}_1$, $\mathbf{46}_N$ and control signals 47 are shown in FIGS. 7 and 8 with dashed lies regardless of their pneumatic or electric nature, and possible electro/pneumatic transducers are not shown, and vice-versa.

In particular, control unit 60 of compression unit 105 of FIG. 7, or the device for changing the compression ratio thereof, is configured to generate closing control signals and to transfer them to actuators of valves V11, V5, V8, V9, and is also configured to generate opening control signals and to transfer them to actuators of valves V2, V3, V4, V6, V7, V10, so that valves V2-V11 are in the open or closed conditions to set a two-compression-steps working condition as long as the value of the overall pressure ratio of delivery pressure $\mathbf{46}_N$ to of suction pressure $\mathbf{45}_1$ is lower than a predetermined threshold value and/or the value of suction pressure $\mathbf{45}_1$ is higher than a predetermined threshold value. When the value of the ratio of pressures $\mathbf{46}_N$ and $\mathbf{45}_1$ exceeds the corresponding threshold value, and/or the value of suction pressure $\mathbf{45}_1$ becomes lower than the corresponding threshold value, for instance, as the evacuation of closed space 80 proceeds, then control unit 60 is configured to invert opening/closing control signals 47 so that valves V2-V11 switch to their open or closed state to set a four-compression-steps working condition, as described above, thus reaching the maximum compression ratio value that is allowed by the compressor. For the sake of brevity, the obvious description of the opposite passage, which can occur if compression unit 105 is used as a process apparatus in a continuous service for conveying a gas from a suction space 8 at a suction pressure to a delivery space 9 at a delivery pressure, where the suction pressure and/or the delivery pressure can change significantly, to such an extent to require a change of the compression ratio.

In a conceptually similar way, control unit 60 of compression unit 106 of FIG. 8, or of device 4 for changing the compression ratio thereof, is configured to generate closing control signals and to and transfer them to actuators of all commutation valves W1-W5 so as to set a single-compression-step working condition as long as the value of the pressure ratio of delivery and suction $\mathbf{46}_N$ and $\mathbf{45}_1$ is lower than a first predetermined threshold value and/or value of suction pressure $\mathbf{45}_1$ is larger than a first predetermined threshold value. When the value of the pressure ratio $\mathbf{46}_N$ and $\mathbf{45}_1$ exceeds the corresponding first threshold value, and/or the value of suction pressure $\mathbf{45}_1$ becomes lower than the corresponding first threshold value, for example, as the evacuation of closed space 80 proceeds, then control unit 60 is configured to change the status of opening/closing control signals 47 so that valves W1-W5 switch to the open or closed state to set the two-compression-steps working condition, as described above. Subsequently, when the value of the ratio of pressure $\mathbf{46}_1$ to pressure $\mathbf{45}_1$ exceeds a corresponding second threshold value, and/or the value of suction pressure $\mathbf{45}_1$ becomes lower than a corresponding second threshold value, then control unit 60 is configured to invert opening/closing control signals 47, with respect in their previous state, so that valves W1-W5 switch to the open or closed state to set the four-compression-steps working condition, as described above, thus reaching the maximum value of compression ratio allowed by the compressor. Even in this case, the obvious description of the opposite passage from a larger number to a smaller number of compression steps is omitted for the sake of brevity.

In FIGS. 7 and 8 two cylinder-piston units 10, 20 are shown, however, as anticipated when describing FIG. 4, the skilled person, by reading the present description, will be able to identify the structure and understand the operation of a compression unit, according to the invention, including four or more both single-bore and double-bore cylinder-piston units. Moreover, even if FIGS. 7 and 8 show only double-acting cylinder-piston units, single-acting cylinder-piston units 10, 20 can be used as well.

Moreover, in FIGS. 7 and 8 commutation valves V2-V11 and W1-W6 are two-ways valves, however, an equivalent number of three-way valves, not shown, can be used as well, replacing at least in part the two-way valves V2-V11 and W1-W6.

For instance, compression unit 105, 106 according to the invention can be reserved to the evacuation of a closed space 80. In this case, compression unit 105, 106 will operate in an intermittent service, for example, in connection with plant shutdowns for production or maintenance reasons.

As an alternative, compression unit 105, 106 according to the invention can be also used for other services, in a mixed service including substantially continuous steps for such further services, in a working condition with a suitable number of compression steps selected among the available conditions, and occasionally occurring steps in which a closed space 80 is evacuated.

For example, if closed space 80 include the main compressor, not shown, of a natural gas compression facility, during normal operation of the latter, compression unit 105, 106 can be also used in a substantially continuous service to recover a gas that unavoidably leaks from the compressor seal and, more in general, to recover any plant vent (flare down), and to convey these vent into gas pipeline 90 (FIG. 1) so as to prevent even in this case the gas from being emitted as such or burnt into the atmosphere.

Since the above-mentioned plant vents are normally available at a pressure about 0,2-0,8 bar gauge, which is the same order of magnitude as the pressure in closed space 80 at the end of the evacuation, in the substantially continuous steps of recovering the vents compression units 105, 106 advantageously operate in the same working condition as at the end of an evacuation step, i.e., in both cases, a four-compression-steps working condition.

In the case of compression unit 105 of FIG. 7, with single-bore cylinders 10, 20, the compressor operates in a four-compression-steps working condition to recover the vents, turns to a two-compression-steps working condition at the beginning of an evacuation required to allow a plant shutdown, and turns back to the four-compression-steps working condition when pressure $P_{sc}$ in closed space 80 to be evacuated drops to the prefixed value to trigger the passage from two- to four-compression-steps working condition, as the evacuation proceeds.

In the case of compression unit 106 of FIG. 8, with double-bore cylinders 10, 20, the compressor operates in a four-compression-steps working condition to recover the vents, turns to a single-compression-step working condition when a plant shutdown occurs, and turns back to a two-compression-steps working condition and then to a four-compression-steps working condition, when pressure $P_{sc}$ in closed space 80 to be evacuated subsequently drops to the prefixed values to trigger the passage from single-compression-step working condition to two-compression-steps working condition, and then from two-compression-steps working condition to four-compression-steps working condition.

In a further alternative embodiment, compression units 105, 106 equipped with device 4, according to the invention, for changing the compression ratio thereof, can be used in a continuous service as a process compressor, when a gas has to be conveyed from a suction space 80, at a suction pressure, to a delivery space 90, at a delivery pressure, wherein the suction pressure and/or the delivery pressure can change significantly.

With reference to FIGS. 1-4 and 7, 8, it falls within the scope of the invention also a method for changing the compression ratio of a reciprocating compressor 3, said reciprocating compressor 3 comprising an inlet port 40 for a gas to be compressed 8 and an outlet port 50 for a compressed gas 9, and also comprising a plurality of piston-cylinder units 1, 10, 20 that define a plurality of compression chambers $\mathbf{2}_i$, 12, 17, 22, 27 pneumatically connected between said inlet port 40 and said outlet port 50, wherein said method comprises the steps of:

prearranging, on said reciprocating compressor, a plurality of commutation valves V, V2-V11, W1-W5 for changing the number of compression steps of reciprocating compressor 3, each commutation valve configured to switch from a respective open status to a respective closed status, and vice-versa;

receiving said gas to be compressed 8 in said reciprocating compressor 3 through said inlet port 40 and compressing said gas, thus obtaining said compressed gas 9 at said outlet port 50;

causing said plurality of commutation valves V, V2-V11, W1-W5 to switch from a first open and/or closed state combination, in which compression chambers of a first number of said compression chambers $\mathbf{2}_i$, 12, 17, 22, 27 are serially connected to one another, to a second open and/or closed state combination, in which compression chambers of a second number of said compression chambers $\mathbf{2}_i$, 12, 17, 22, 27 are serially connected to one another, or vice-versa, wherein said first number is lower than said second number, such that a number of compression steps of said gas to be compressed 8 increases when switching from said first to said second combination, and decreases when switching from said second to said first combination.

said method also comprising the steps of:

measuring a first pressure $\mathbf{45}_1$ of said gas to be compressed 8 and a second pressure $\mathbf{46}_N$ of said compressed gas 9 upstream and downstream of said reciprocating compressor 3, respectively;

computing a pressure ratio between said second pressure $\mathbf{46}_N$ and said first pressure $\mathbf{45}_1$;

and said step of causing said plurality of commutation valves V, V2-V11, W1-W5 to switch from said first to said second open and/or closed state combination is carried out when said pressure ratio becomes higher than an overall threshold value, and said step of causing said plurality of commutation valves V, V2-V11, W1-W5 to switch from said second to said first open and/or closed state combination is carried out when said pressure ratios becomes lower than said overall threshold value.

The foregoing description of exemplary embodiments of the invention will so fully reveal the invention according to the conceptual point of view, so that others, by applying current knowledge, will be able to modify and/or adapt these embodiments for various applications without further research and without parting from the invention, and, accordingly, it is meant that such adaptations and modifications will have to be considered as equivalent to the exemplary embodiments. The means and the materials to realise the different functions described herein could have a different nature without, for this reason, departing from the scope of the invention. It is to be understood that the phraseology or terminology that is employed herein is for the purpose of description and not of limitation.

The invention claimed is:

1. A method for changing the compression ratio of a reciprocating compressor, said reciprocating compressor including an inlet port for a gas to be compressed and an outlet port for a compressed gas, and a plurality of piston-cylinder units defining a plurality of compression chambers that are pneumatically connected between said inlet port and said outlet port, said method comprising:

prearranging, on said reciprocating compressor, a plurality of commutation valves for changing a number of compression steps of the reciprocating compressor, each commutation valve being configured to switch from a respective open status to a respective closed status, and vice-versa;

receiving said gas to be compressed into said reciprocating compressor through said inlet port, and compressing said gas to be compressed, thus obtaining said compressed gas at said outlet port;

causing said plurality of commutation valves to switch;

from a first open and/or closed state combination, in which compression chambers of a first number of said compression chambers are serially connected to one another, to a second open and/or closed state combination, in which compression chambers of a second number of said compression chambers are serially connected to one another, or vice-versa, prearranging a control unit;

prearranging a first and a second pressure sensor upstream and downstream of said reciprocating compressor, respectively;

measuring a first pressure of the gas to be compressed and a second pressure of the compressed gas by said first and said second pressure sensor, respectively, and generating a first signal and a second signal of said first and of said second pressure, respectively, by said first and said second pressure sensor respectively;

receiving said first and said second pressure signal in said control unit;

calculating, by said control unit, an overall pressure ratio of said second pressure signal to said first pressure signal;

generating, by said control unit, a plurality of opening/closing control signals of said commutation valves responsive to said overall pressure ratio; and transferring said opening/closing control signals to actuator elements of said commutation valves, wherein;

said first number of compression chambers is lower than said second number of compression chambers, such that the number of compression steps of said gas to be compressed increases when switching from said first to said second combination, and decreases when switching from said second to said first combination, and said opening/closing signals are configured in such a way that said commutation valves switch:

from said first open and/or closed state combination to said second open and/or closed state combination when said overall pressure ratio becomes higher than a predetermined overall threshold value, and from said second open and/or closed state combination to said first open and/or closed state combination when said overall pressure ratio becomes lower than said overall threshold value.

2. The method according to claim 1, further comprising:

prearranging an upstream pressure sensor and a downstream pressure sensor upstream and downstream of each of said compression chambers, respectively;

measuring an upstream pressure and a downstream pressure upstream and downstream of each of said compression chambers, respectively, by said upstream pressure sensor and said downstream pressure sensor, respectively, and generating upstream and downstream pressure signals, respectively, each by said upstream pressure sensor and said downstream pressure sensor, respectively;

receiving said upstream and downstream pressure signals in said control unit;

calculating, by said control unit, a plurality of single-step pressure ratios between said downstream pressure signals and respective upstream pressure signals, upstream and downstream of respective compression chambers;

generating, by said control unit, a plurality of opening/closing control signals of said commutation valves responsive to said single-step pressure ratios; and transferring said opening/closing control signals to actuator elements of said commutation valves, wherein said opening/closing signals are configured in such a way that said commutation valves switch:

from said first open and/or closed state combination to said second open and/or closed state combination when at least one of said single-step pressure ratios becomes higher than a predetermined single-step threshold value, and from said second open and/or closed state combination to said first open and/or closed state combination when at least one of said single-step pressure ratios becomes lower than said single-step threshold value.

3. The method according to claim 1, wherein;

said gas to be compressed is withdrawn from a closed space from which said gas to be compressed has to be evacuated from an initial pressure to a final pressure, and said compressed gas is sent to a reception space at a predetermined working pressure that remains substantially unchanged during said steps of receiving and compressing said gas to be compressed.

4. The method according to claim 3, wherein said closed space to be evacuated comprises a portion of a compression facility of a gas pipeline, and said reception space is said gas pipeline.

5. The method according to claim 4, wherein said compression facility includes a main compressor of said gas pipeline.

6. The method according to claim 3, wherein said reciprocating compressor is arranged to perform a recovering a lost gas leaking from said closed space when said closed space is engaged in an operation different from said evacuating said gas to be compressed, wherein, during said recovering of the lost gas, said commutation valves have said second open and/or closed state combination.

7. The method according to claim 1, wherein;

said reciprocating compressor is a process compressor installed between a suction environment at a suction pressure and a delivery environment at a delivery pressure, and said suction and delivery pressures change in such a way to cause said overall pressure ratio to change by at least one order of magnitude.

8. A device for changing the compression ratio of a reciprocating compressor that includes an inlet port for a gas to be compressed and an outlet port (50) for a compressed gas, and a plurality of piston-cylinder units defining a plurality of compression chambers pneumatically that are connected between said inlet port and said outlet port, said device comprising:

a plurality of commutation valves for changing a number of compression steps, each of said commutation valves configured to switch from a respective open status to a respective closed status, and vice-versa, wherein said commutation valves are arranged:

to switch:

from a first open and/or closed state combination, in which compression chambers of a first number of said compression chambers are serially connected to one another, to a second open and/or closed state combination, in which compression chambers of a second number of said compression chambers are serially connected to one another, wherein said first number of compression chambers is lower than said second number of compression chambers, and to switch:

from said second open and/or closed state combination to said first open and/or closed state combination, such that the number of compression steps of said gas to be compressed increases when switching from said first to said second open and/or closed state combination, and decreases when switching from said second to said first open and/or closed state combination, a first pressure sensor arranged upstream of said reciprocating compressor and a second pressure sensor arranged downstream of said reciprocating compressor; and a control unit configured to:

receive a first pressure signal from said first pressure sensor and a second pressure signal from said second pressure sensor;

calculate an overall pressure ratio of said second pressure signal to said first pressure signal;

generate a plurality of opening/closing control signals of said commutation valves responsive to said overall pressure ratio; and transfer said opening/closing control signals to actuator elements of said commutation valves, wherein said opening/closing signals are configured in such a way that said commutation valves switch:

from said first open and/or closed state combination to said second open and/or closed state combination when said overall pressure ratio becomes higher than a predetermined overall threshold value, and from said second open and/or closed state combination to said first open and/or closed state combination when said overall pressure ratio becomes lower than said overall threshold value.

9. The device according to claim 8, further comprising:

an upstream pressure sensor and a downstream pressure sensor arranged upstream and downstream, respectively, of each of said compression chambers;

wherein:

the control unit is configured to:

receive upstream pressure signals from each upstream pressure sensor and downstream pressure signals from each downstream pressure sensor;

calculate a plurality of single-step pressure ratios between said downstream pressure signals and respective upstream pressure signals, upstream and downstream of respective compression chambers;

generate a plurality of opening/closing control signals of said commutation valves responsive to said single-step pressure ratios; and transfer said opening/closing control signals to actuator elements of said commutation valves, and said opening/closing signals are configured in such a way that said commutation valves switch:

from said first open and/or closed state combination to said second open and/or closed state combination when at least one of said single-step pressure ratios becomes higher than a predetermined single-step threshold value, and from said second open and/or closed state combination to said first open and/or closed state combination when at least one of said single-step pressure ratios becomes lower than a predetermined single-step threshold value.

10. The device according to claim 8, further comprising a housing box enclosing said commutation valves and being configured to be mounted to said reciprocating compressor.

11. A compression unit comprising:

a reciprocating compressor including an inlet port for a gas to be compressed and an outlet port for a compressed gas, and a plurality of piston-cylinder units defining a plurality of compression chambers that are pneumatically connected between said inlet port and said outlet port, a device for changing the compression ratio of said reciprocating compressor, said device including a plurality of commutation valves for changing a number of compression steps, each being configured to switch from a respective open status to a respective closed status, and vice-versa, wherein said commutation valves are arranged:

to switch:

from a first open and/or closed state combination, in which compression chambers of a first number of said compression chambers are serially connected to one another, a second open and/or closed state combination, in which compression chambers of a second number of said compression chambers are serially connected to one another, wherein said first number is lower than said second number, and to switch from said second open and/or closed state combination to said first open and/or closed state combination, such that the number of compression steps of said gas to be compressed increases when switching from said first to said second combination, and decreases when switching from said second to said first combination, a first pressure sensor arranged upstream of said reciprocating compressor and a second pressure sensor arranged downstream of said reciprocating compressor; and a control unit configured to:

receive a first pressure signal from said first pressure sensor and a second pressure signal from said second pressure sensor;

calculate an overall pressure ratio of said second pressure signal to said first pressure signal;

generate a plurality of opening/closing control signals of said commutation valves responsive to said overall pressure ratio; and transfer said opening/closing control signals to actuator elements of said commutation valves, wherein said opening/closing signals are configured in such a way that said commutation valves switch:

from said first open and/or closed state combination to said second open and/or closed state combination when said overall pressure ratio becomes higher than a predetermined overall threshold value, and from said second open and/or closed state combination to said first open and/or closed state combination when said overall pressure ratio becomes lower than said overall threshold value.

* * * * *